US012607025B2

(12) United States Patent
Su et al.

(10) Patent No.: US 12,607,025 B2
(45) Date of Patent: Apr. 21, 2026

(54) FALLING PREVENTION STRUCTURE FOR ATTACHED LIFT SCAFFOLD

(71) Applicants: Quanyun Su, Chengdu (CN); Siyue Su, Chengdu (CN); Maobing Su, Chengdu (CN)

(72) Inventors: Quanyun Su, Chengdu (CN); Siyue Su, Chengdu (CN); Maobing Su, Chengdu (CN); Changniu Yang, Chengdu (CN)

(73) Assignees: Quanyun Su, Chengdu (CN); Siyue Su, Chengdu (CN); Maobing Su, Chengdu (CN)

( * ) Notice: Subject to any disclaimer, the term of this patent is extended or adjusted under 35 U.S.C. 154(b) by 1027 days.

(21) Appl. No.: 17/281,241

(22) PCT Filed: Jul. 5, 2019

(86) PCT No.: PCT/CN2019/094900
§ 371 (c)(1),
(2) Date: Mar. 30, 2021

(87) PCT Pub. No.: WO2020/258368
PCT Pub. Date: Dec. 30, 2020

(65) Prior Publication Data

US 2021/0404193 A1 Dec. 30, 2021

(30) Foreign Application Priority Data

Jun. 27, 2019 (CN) ..... 201910565623.6

(51) Int. Cl.
*E04G 3/32* (2006.01)
*E04G 5/00* (2006.01)
*E04G 3/28* (2006.01)

(52) U.S. Cl.
CPC ..... *E04G 3/32* (2013.01); *E04G 5/001* (2013.01); *E04G 2003/286* (2013.01)

(58) Field of Classification Search
CPC ..... E04G 3/32; E04G 3/325; E04G 2003/286; E04G 5/001; E04G 5/04; E04G 5/046;
(Continued)

(56) References Cited

U.S. PATENT DOCUMENTS 1,113,667 A * 10/1914 Mahaj ..... E05B 85/22 292/164
1,470,382 A * 10/1923 Lance ..... E05D 13/06 292/40

(Continued)

FOREIGN PATENT DOCUMENTS

CN 201241462 Y 5/2009
CN 101956452 A 1/2011

(Continued)

*Primary Examiner* — Colleen M Chavchavadze
(74) *Attorney, Agent, or Firm* — NKL Law; Allen Xue

(57) ABSTRACT

A falling prevention structure can be stably connected to an attached lift scaffold body and is provided with a hinge point in the middle. The control arm is on one side of the hinge point, and an extension portion of the control arm can be connected/matched with a lifting structure of the attached lift scaffold. An operating arm is on the other side of the hinge point, an extension portion of the operating arm is provided with a transition structure and connected to a falling prevention pin by the transition structure. The falling prevention pin is provided with an elastic restoring structure and is capable of extending and retracting, and the extending falling prevention pin can be inserted into a clamping and hanging structure in a falling prevention structure directly or indirectly fixed to a building object.

3 Claims, 1 Drawing Sheet

(58) Field of Classification Search
CPC ..... E04G 21/3247; E04G 11/24; E04G 21/32; E04G 21/3204; E04G 2005/008; E06C 7/186; E06C 7/187; E05D 13/006
See application file for complete search history.

(56) References Cited

U.S. PATENT DOCUMENTS

| | | | | | |
|---|---|---|---|---|---|
| 1,663,131 | A * | 3/1928 | Johnston | E04G 3/32 | 182/147 |
| 3,115,211 | A * | 12/1963 | Ostrander, Jr. | E06C 7/12 | 187/241 |
| 4,040,774 | A * | 8/1977 | Scheller | E04G 11/28 | 254/338 |
| 4,078,633 | A * | 3/1978 | Fahy | E04G 3/265 | 182/229 |
| 4,080,757 | A * | 3/1978 | Westerman | E05B 65/0021 | 292/171 |
| 4,129,197 | A * | 12/1978 | Preston | E04G 21/3266 | 182/138 |
| 4,862,997 | A * | 9/1989 | Eberle | A61G 5/128 | 187/244 |
| 5,265,696 | A * | 11/1993 | Casebolt | A62B 1/14 | 182/8 |
| 5,855,251 | A * | 1/1999 | Deuer | A62B 1/14 | 182/5 |
| 6,042,158 | A * | 3/2000 | Horn | E05D 13/006 | 292/DIG. 36 |
| 6,056,086 | A * | 5/2000 | Gortan | A62B 1/14 | 182/234 |
| 6,178,790 | B1 * | 1/2001 | Chiarelli | E05C 1/14 | 292/171 |
| 7,909,139 | B2 * | 3/2011 | Blue | A01M 31/02 | 182/103 |
| 9,303,418 | B2 * | 4/2016 | Schwoerer | E04G 11/28 | |
| 9,777,755 | B2 * | 10/2017 | Lowe | F15B 15/26 | |
| 9,834,944 | B2 * | 12/2017 | Maurer | B66B 9/022 | |
| 9,874,034 | B2 * | 1/2018 | Ostrobrod | F16D 63/008 | |
| 9,963,889 | B2 * | 5/2018 | Shen | E04G 3/32 | |
| 10,590,664 | B2 * | 3/2020 | Aranburu Etxezarreta | E04G 3/28 | |
| 11,346,117 | B2 * | 5/2022 | Faresin | E04G 21/3247 | |
| 2007/0056802 | A1 * | 3/2007 | Taberah | E04G 1/20 | 182/141 |

FOREIGN PATENT DOCUMENTS

| | | | | |
|---|---|---|---|---|
| CN | 202064624 | U | | 12/2011 |
| CN | 202081630 | U | | 12/2011 |
| CN | 202099991 | U | | 1/2012 |
| CN | 202248828 | U | * | 5/2012 |
| CN | 202644964 | U | | 1/2013 |
| CN | 202831602 | U | | 3/2013 |
| CN | 203684637 | U | | 7/2014 |
| CN | 203856188 | U | | 10/2014 |
| CN | 204152182 | U | | 2/2015 |
| CN | 208633481 | U | | 3/2019 |
| CN | 210239093 | U | | 4/2020 |
| JP | 2001146885 | A | | 5/2001 |
| JP | 2013019195 | A | | 1/2013 |
| JP | 2014152467 | A | | 8/2014 |
| KR | 101459236 | B1 | | 11/2014 |

* cited by examiner

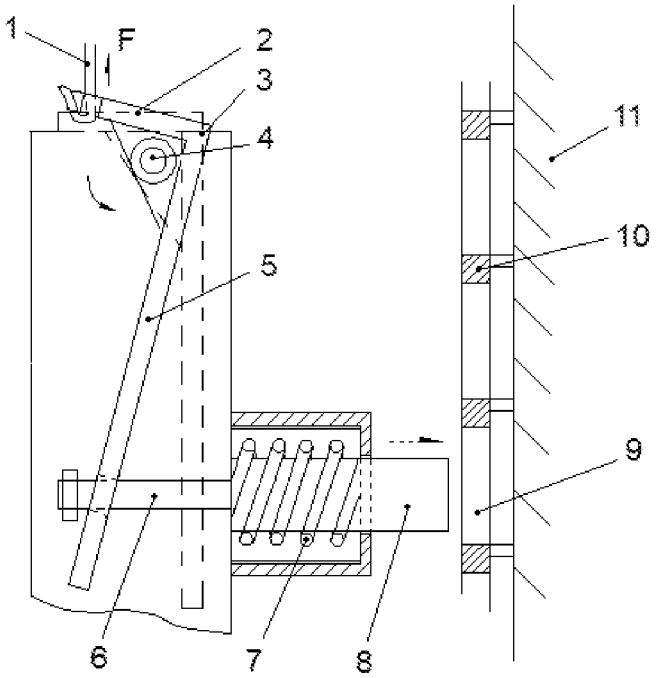
1
F
2
3
4
5
6
7
8
9
10
11

FALLING PREVENTION STRUCTURE FOR ATTACHED LIFT SCAFFOLD

TECHNICAL FIELD

The present invention relates to a falling prevention structure for an attached lift scaffold for suspending operation.

BACKGROUND

High-rise and super high-rise buildings have become widespread in cities. At present, the construction of high-rise and super high-rise buildings mostly use a suspended lifting scaffold (that is, an attached lift scaffold) controlled by group machines, instead of a traditional full-height erected floor fixed scaffold, that is, an attached lift scaffold having a height not more than 5 storeys is mounted, and as the building storeys increase, the scaffold is suspended and gradually raised for construction. The construction of the attached lift scaffold uses the operation of the group machines to suspend and lift a frame having a height of 4-5 storeys instead of the original suspending operation that needs to erect a scaffold frame having a full building height. When a lifting system controlled by the group machines runs, once an individual machine station fails and stops running, because the surrounding machine stations still run normally, the weight of these machine stations and even the whole-span attached lift scaffold gradually concentrates toward the failing machine station, until the weight exceeds the limit borne by the failing machine station and collapse and fall occur. As a result, a chain reaction occurs to cause the collapse and fall of the whole-span attached lift scaffold, leading to serious accidents of fatal crash and property losses. This situation has happened more than once. Therefore, a safety protection system for the attached lift scaffold, especially for preventing the attached lift scaffold from collapsing and falling, has always been a key and important part. China has issued technical standards and regulations/specifications required to be implemented, such as CECS 373: 2014 Technical Specification for Application of Inserted False-Work and Synchronous Control System, JGJ202-2010 Technical Code for Safety of Implementation Scaffold Practice in Construction, JGJ59-2011 Standard for Construction Safety Inspection, and JGJ 160-2016 Technical Specification for Inspection of Machinery and Equipment on Construction Site.

Through careful analysis and research on the collapse and fall of the attached lift scaffold, it is found according to statistics that most of the falling prevention accidents occur during the descending phase of group machine control. This is because, during the descending process, after an individual machine station fails and stops running, an electric loop chain of a surrounding hoist continues to be released to make group machines run down, but a chain of a hoist at the failing machine station stops, causing adjacent machine stations to gradually spread to farther machine stations, and even the weight of the whole-span attached lift scaffold gradually concentrates toward the failing machine station, until the weight exceeds the limit borne by the failing machine station and collapse and fall occur; and during the ascending operation of group machine control, even if the individual machine station fails and stops running, because the electric loop chain of the surrounding hoist continues to be tightened and lifted upward, there is only the load burden of the individual failing machine station among the ascending group machines of the entire attached lift scaffold, and the adjacent machine stations are gradually scattered to farther machine stations. Therefore, the attached lift scaffold in the lifting phase has few accidents.

In order to solve the problem of collapse and fall of the attached lift scaffold, some corresponding falling prevention devices/structures have been reported and/or used. These existing falling prevention systems for attached lift scaffolds can be roughly divided into two categories: impact type falling prevention systems and friction type falling prevention systems. The impact type falling prevention systems can further include speed type falling prevention systems and top support type falling prevention systems. For example, the impact force of an object borne by an impact type falling prevention system comprises component forces in a vertical direction and a horizontal direction, wherein the component force in the horizontal direction causes a falling prevention member to retract and deform, and therefore is a harmful component force causing direct separation of the falling object and the falling prevention member, which directly affects the falling prevention effect and even leads to complete failure of the falling prevention system. At the moment the object falls, the falling prevention member is in direct contact with a scaffold body from a side in an arc-shaped manner, but the contact point is unpredictable. Therefore, the long span in the falling prevention structure results in a long falling distance, which can reach 150 mm or more.

The typical representative of the speed type falling prevention systems is a pendulum needle type falling prevention device. Its structure comprises a pendulum needle that is provided with a reset spring and can swing back and forth, the pendulum needle is connected with a shaft seat fixed on a guide seat, and the guide seat cooperates with a sliding sleeve of a guide rail. In a normal slow running state, a connecting rod in the guide rail cooperates with the pendulum needle within the range of motion, and pushes the pendulum needle to periodically swing back and forth, so that the guide rail continuously smoothly passes through the guide seat. When a fall occurs, the guide rail quickly descends, and when the pendulum needle has not completed a swing cycle to reset, the other connecting rod enters the range of swing of the pendulum needle, so that the pendulum needle cannot rebound to reset but blocks the guide rail to achieve the purpose of preventing falling.

A top support type falling prevention device works by means of the ratchet-pawl principle. Falling prevention teeth fixed on a guide rail are equivalent to a ratchet having an infinite diameter, a falling prevention rod fixed on the device is equivalent to a pawl, and the falling prevention rod is connected with a hoisting chain of a hoist. During normal operation, the device does not work, and the scaffold can pass smoothly. When the hoisting chain breaks or the load of the hoist disappears due to other reasons, and the scaffold starts to fall, the falling prevention device is activated, and the falling prevention rod supports the falling prevention teeth to prevent the scaffold from falling.

The falling prevention principle of the friction type falling prevention system is, when a falling accident occurs, the loss of gravity causes a compression spring in the structure to push a manipulator downward, the manipulator pushes a movable block of an oblique cone to be wedged between a buckling body and a falling prevention suspender, and the movable block is wedged increasingly tightly to achieve instant braking and prevent continued falling.

It can be seen that the common characteristic and problem of these existing falling prevention systems/structures are that their falling prevention operations are all activated after the fall occurs, and their working process and principle require the falling prevention member to be in motion contact with the falling object from the side during falling, and to directly bear the impact force of the falling object to achieve falling prevention.

The falling prevention can be divided into passive falling prevention and active falling prevention. The passive falling prevention is to prevent continued falling of the falling object after the fall has occurred. The active falling prevention is to eliminate the danger of a falling accident at the stage of hidden danger when the sign or precursor of a fall appears, but the actual fall has not really started. Obviously, the active falling prevention is more significant to ensuring of the safety of construction.

SUMMARY

In view of this, the present invention provides a falling prevention structure for an attached lift scaffold, which can have the functions of active falling prevention and passive falling prevention, especially its active falling prevention function can fundamentally solve the problems of collapse and fall of the existing attached lift scaffold.

A falling prevention structure for an attached lift scaffold according to the present invention has a basic structure that on a leveraged structure that can be stably connected to an attached lift scaffold body and is provided with a hinge point in the middle, a control arm is on one side of the hinge point, and an extension portion of the control arm can be connected/matched with a lifting structure of the attached lift scaffold; an operating arm is on the other side of the hinge point, an extension portion of the operating arm is provided with a transition structure and connected to a falling prevention pin by the transition structure, the falling prevention pin is provided with an elastic restoring structure and is capable of extending and retracting, and the extending falling prevention pin can be inserted into a clamping and hanging structure in a falling prevention structure directly or indirectly fixed to a building object to achieve falling prevention clamping and hanging cooperation.

The meaning that the hinge point is located at the midpoint of the leveraged structure in the above structure does not mean that the hinge point must be located at a ½ midpoint of a length direction of the leveraged structure, but is allowed to be located at any suitable position between a portion of connection/matching with the lifting structure of the attached lift scaffold and a portion of connection with the transition structure on the leveraged structure. Not only that, if an unequal length mode that a length of the control arm between the hinge point and the portion of connection/matching with the lifting structure of the attached lift scaffold is smaller than a length of the operating arm between the hinge point and the portion of connection with the transition structure is further used, the sensitivity of operation on the transition structure and the falling prevention pin when the falling prevention operation is activated can be further improved.

On the basis of the above basic structure, in addition to a conventional linear structure, the leveraged structure is preferably of a turning structure with a turning angle in the middle, including a turning structure with a right angle or other suitable angle, which is beneficial to reducing the space occupied by the falling prevention structure. In this case, the hinge point can be arranged at a turning portion where the turning angle is located.

In the falling prevention structure for the attached lift scaffold, in a further preferred mode, the transition structure and the falling prevention pin capable of extending and retracting are of an integral structure, which is beneficial to further improving and enhancing the reliability of the falling prevention effect. For the attached lift scaffold that works in the open air and under harsh working conditions of dusty sandstones and the like, the simple structure is beneficial to reducing the occurrence of failures and improving its working reliability.

In the above structure, the elastic restoring structure matched with the falling prevention pin capable of extending and retracting can be a spring structure in a suitable form including a compression type or an extension type commonly used at present according to actual conditions. For example, a compression spring is used in a specific embodiment.

The working principle and process of the above falling prevention structure for the attached lift scaffold according to the present invention are: since the control arm of the leveraged structure in the above falling prevention structure of the present invention is connected/matched with the lifting structure, the lifting structure always maintains an upward lifting force (F) for the attached lift scaffold and the control arm of the falling prevention structure regardless of ascending or descending during normal operation, the operating arm of the leveraged structure drives the falling prevention pin through the transition structure to retract against the elastic force of the elastic restoring structure, and the falling prevention pin does not implement a falling prevention cooperation of clamping and hanging with the clamping and hanging structure in the falling prevention structure directly or indirectly fixed to the building object, which ensures normal ascending and descending operations of the attached lift scaffold. During the descending process, when a certain machine station stops running due to a failure, the lifting structure such as an electric loop chain of the lifting mechanism still continues to descend, so that the lifting structure loses the upward lifting force for the attached lift scaffold and the control arm of the falling prevention structure and is loosened, then the falling prevention pin driven by the operating arm loses the force against the elastic force of the elastic restoring structure, at this time, the elastic force of the elastic restoring structure pushes the falling prevention pin to quickly extend out and be inserted into the clamping and hanging structure in the falling prevention structure directly or indirectly fixed to the building object to enter a falling prevention clamping and hanging cooperation state, and the gravity gradually concentrated from other machine stations can be transmitted to the building object to avoid bearing by a failing machine station alone; meanwhile, after the failing machine station stops running, surrounding machine stations are implicated and also stop running, falling prevention pins of falling prevention structures on these machine stations also carry out the same operation to transmit the gravity borne by them to the building object respectively, so that all the gravity that can cause collapse and fall is dispersed to the building object to avoid concentrated bearing on the failing machine station. In this way, when the operation of the attached lift scaffold has a failure that can cause a fall, but the collapse has not actually occurred, the fall can be quickly eliminated and prevented at the sign or precursor of hidden danger of a falling accident, and the occurrence of collapse and falling accidents is timely and effectively avoided. On the other hand, even if the collapse and fall have occurred quickly, because the above falling prevention structure of the present invention is simple, the operating arm of the leveraged structure operates quickly. Test results show that, the actual falling distance even during passive falling prevention is less than 42 mm, which is far lower than 150 mm specified in the industry standard Safety Protection Platform for Attached lifting Operation for Building Construction, thereby effectively guaranteeing construction safety.

It can thus be seen that the working principle and process of falling prevention of the above falling prevention structure for the attached lift scaffold according to the present invention are completely different from those of the existing friction type falling prevention system and impact type falling prevention system which are required to be in contact with a falling object during falling prevention when an actual fall has occurred, but to prevent and eliminate a fall at the sign before the actual fall happens by preoccupying a position for preventing the fall. Therefore, the falling prevention structure has a falling prevention effect, and even during passive falling prevention, its effective falling prevention distance is also significantly shorter than the current required standard, thereby effectively guaranteeing construction safety.

The above content of the present invention will be further described in detail below in conjunction with specific implementation modes of embodiments shown in the drawing. However, it should not be understood that the scope of the above subject of the present invention is limited to the following embodiments. Various substitutions or changes made according to common technical knowledge and conventional means in the art without departing from the above technical idea of the present invention should all be included in the scope of the present invention.

BRIEF DESCRIPTION OF THE DRAWING

FIG. 1 is a schematic diagram of a falling prevention structure for an attached lift scaffold according to the present invention.

DETAILED DESCRIPTION

As shown in FIG. 1, in a falling prevention structure for an attached lift scaffold according to the present invention, on a leveraged structure 3 that can be stably connected to an attached lift scaffold body and is provided with a hinge point 4 of a hinge structure by conventional means in the middle, a control arm 2 is on one side of the hinge point 4, and an extension portion (usually an end portion) of the control arm 2 can be connected/matched with a lifting structure 1 (such as a lifting hook of an electric loop chain of a conventional hoist) of the attached lift scaffold; an operating arm 5 is on the other side of the hinge point 4, an extension portion (usually an end portion or a proximal portion) of the operating arm 5 is provided with a transition structure 6 in the form of a connecting rod or the like and connected to a falling prevention pin 8 by the transition structure 6, the falling prevention pin 8 is provided with an elastic restoring structure 7 in a proper form such as a compression spring and is capable of extending and retracting, and the extending falling prevention pin (8) can be inserted into a clamping and hanging structure 9 such as a clamping hole in a falling prevention structure 10 such as a falling prevention steel plate directly or indirectly fixed to a building object 11 to achieve falling prevention clamping and hanging cooperation. The leveraged structure 3 is of a turning structure with a right angle or other proper turning angle in the middle, the hinge point 4 is arranged at a turning position where the turning angle is located, and a length of the control arm 2 between the hinge point 4 and a portion of connection/matching with the lifting structure 1 of the attached lift scaffold is smaller than a length of the operating arm 5 between the hinge point 4 and a portion of connection with the transition structure 6. The transition structure 6 and the falling prevention pin 8 capable of extending and retracting are of an integral rod structure.

The invention claimed is:

1. A falling prevention system comprising a falling prevention structure adapted to be directly or indirectly affixed to a building object and a lift scaffold movable along the building object, wherein the lift scaffold comprises a lifting structure, a leveraged structure, a transition rod connected to a falling prevention pin in contact with an elastic restoring structure, wherein the leveraged structure has a control arm having a first end and a second end and an operating arm having a first end and a second end, wherein the second end of the control arm and the first end of the operating arm meet at a joint and form a fixed angle having the joint as a vertex of the fixed angle, wherein a hinge point is disposed in an interior of the fixed angle adjacent to the joint, wherein the first end of the control arm is attached to the lifting structure and the second end of the operating arm is attached to the transition rod, wherein, when the lifting structure exerts an upward force on the control arm, the leveraged structure rotates about the hinge point so that the operating arm retracts the transition rod to compress the elastic restoring structure and retracts the fall prevention pin, and when the lift structure does not exert the upward force on the control arm, the leverage structure returns to an initial position so as to extend the transition rod to release the elastic restoring structure to extend the falling prevention pin so that the falling prevention pin inserts into a clamping and hanging structure in the falling prevention structure, and wherein in the leveraged structure, the length of a section of the control arm between the hinge point and a point of connection with the lifting structure is smaller than the length of a section of the operating arm between the hinge point and a point of connection with the transition rod.

2. The falling prevention system according to claim 1, wherein the elastic restoring structure is a compression spring.

3. The falling prevention system of claim 1, wherein the fixed angle is a right angle.

* * * * *